US011430399B2

(12) United States Patent
Shan

(10) Patent No.: US 11,430,399 B2
(45) Date of Patent: Aug. 30, 2022

(54) DRIVING DEVICE AND METHOD FOR LIQUID CRYSTAL DISPLAY PANEL SOLVING PROBLEM OF COLOR SHIFT AT CERTAIN VIEWING ANGLE

(71) Applicant: HKC CORPORATION LIMITED, Shenzhen (CN)

(72) Inventor: Jianfeng Shan, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/033,812

(22) Filed: Sep. 27, 2020

(65) Prior Publication Data

US 2021/0012732 A1 Jan. 14, 2021

Related U.S. Application Data

(63) Continuation of application No. PCT/CN2019/076178, filed on Feb. 26, 2019.

(30) Foreign Application Priority Data

Jan. 30, 2019 (CN) ..... 201910094530.X

(51) Int. Cl.
*G09G 3/36* (2006.01)

(52) U.S. Cl.
CPC ..... *G09G 3/3614* (2013.01); *G09G 3/3607* (2013.01); *G09G 3/3677* (2013.01); *G09G 3/3688* (2013.01)

(58) Field of Classification Search
CPC ..... G09G 3/36; G09G 3/3611; G09G 3/3614; G09G 3/3622; G09G 3/3625; G09G 3/364;

(Continued)

(56) References Cited

U.S. PATENT DOCUMENTS 10,930,235 B2 * 2/2021 Kang ..... G09G 3/3607
2004/0246216 A1 * 12/2004 Hosaka ..... G09G 3/3648 345/87

(Continued)

FOREIGN PATENT DOCUMENTS

CN 107995958 A 5/2018
CN 108107634 A 6/2018

(Continued)

OTHER PUBLICATIONS

First Office Action in counterpart Chinese Application No. 201910094530.X, dated Jan. 19, 2020.

(Continued)

*Primary Examiner* — Alexander Eisen
*Assistant Examiner* — Nelson Lam
(74) *Attorney, Agent, or Firm* — Westbridge IP LLC

(57) ABSTRACT

A driving method and a driving device of a display panel are provided. According to the display panel of the present application, subpixels adjacent in a row direction of the display array have different polarities, and subpixels adjacent in a column direction of the display array have different polarities. Adjacent subpixels have different voltages and are alternately arranged with a higher voltage or a lower voltage. The common electrode voltage required for operating picture of each frame is periodically changed by the driving device, with operational picture of two frames of the display panel taken as one driving cycle. With respect to different frames, different common electrode voltages are correspondingly applied to drive subpixels in the display array, reducing the occurrence rate of viewing angle color shift of display panel.

2 Claims, 5 Drawing Sheets

(58) Field of Classification Search
CPC .. G09G 3/3644; G09G 3/3648; G09G 3/3674; G09G 3/3677; G09G 3/3681; G09G 3/3688; G09G 3/3692
USPC ..... 345/87–104
See application file for complete search history.

(56) References Cited

U.S. PATENT DOCUMENTS

2006/0119557 A1* 6/2006 Sano ..... G09G 3/3614 345/88
2008/0231575 A1* 9/2008 Feng ..... G09G 3/3688 345/89
2009/0109357 A1 4/2009 Liu et al.
2009/0251451 A1* 10/2009 Cha ..... G09G 3/3614 345/211
2011/0018790 A1* 1/2011 Lee ..... G02F 1/136286 345/87
2012/0299972 A1* 11/2012 Bae ..... G09G 3/3614 345/690
2014/0071184 A1* 3/2014 Lu ..... G09G 3/3607 345/690
2016/0140920 A1* 5/2016 Lee ..... G09G 3/3655 345/209
2016/0155393 A1* 6/2016 Jung ..... G09G 3/3648 345/89
2018/0108307 A1 4/2018 Sakurai
2019/0189070 A1* 6/2019 Huang ..... G09G 3/3614
2019/0189071 A1* 6/2019 Huang ..... G09G 3/3607
2020/0090605 A1* 3/2020 Kang ..... G09G 3/3674
2021/0012728 A1* 1/2021 Shan ..... G09G 3/3648

FOREIGN PATENT DOCUMENTS

CN 108831405 A 11/2018
CN 109036319 A 12/2018

OTHER PUBLICATIONS

International Search Report and Written Opinion in corresponding PCT Application No. PCT/CN2019/076178, dated Nov. 13, 2019.
Second Office Action in counterpart Chinese Application No. 201910094530.X, dated May 18, 2020.

* cited by examiner

001

| | | | | | | | | |
|---|---|---|---|---|---|---|---|---|
| VH + R | VL - G | VH + B | VL - R | VH VGd_1 + G | VL - B | VH + R | VL - G | VH + B |
| VL - R | VH + G | VL - B | VH + R | VL VGd_2 - G | VH + B | VL - R | VH + G | VL - B |
| VH + R | VL - G | VH + B | VL - R | VH VGd_3 + G | VL - B | VH + R | VL - G | VH + B |
| VL - R | VH + G | VL - B | VH + R | VL VGd_4 - G | VH + B | VL - R | VH + G | VL - B |
| VH + R | VL - G | VH + B | VL - R | VH VGd_5 + G | VL - B | VH + R | VL - G | VH + B |
| VL - R | VH + G | VL - B | VH + R | VL VGd_6 - G | VH + B | VL - R | VH + G | VL - B |

FIG. 2a

001

| | | | | | | | | |
|---|---|---|---|---|---|---|---|---|
| VH - R | VL + G | VH - B | VL + R | VH VGd_1 - G | VL + B | VH - R | VL + G | VH - B |
| VL + R | VH - G | VL + B | VH - R | VL VGd_2 + G | VH - B | VL + R | VH - G | VL + B |
| VH - R | VL + G | VH - B | VL + R | VH VGd_3 - G | VL + B | VH - R | VL + G | VH - B |
| VL + R | VH - G | VL + B | VH - R | VL VGd_4 + G | VH - B | VL + R | VH - G | VL + B |
| VH - R | VL + G | VH - B | VL + R | VH VGd_5 - G | VL + B | VH - R | VL + G | VH - B |
| VL + R | VH - G | VL + B | VH - R | VL VGd_6 + G | VH - B | VL + R | VH - G | VL + B |

FIG. 2b

DRIVING DEVICE AND METHOD FOR LIQUID CRYSTAL DISPLAY PANEL SOLVING PROBLEM OF COLOR SHIFT AT CERTAIN VIEWING ANGLE

CROSS-REFERENCE OF RELATED APPLICATIONS

The present application is a continuation application of International Patent Application No. PCT/CN2019/076178, filed on Feb. 26, 2019, which claims the benefit of Chinese Patent Application No. 201910094530.X, titled "DRIVING DEVICE AND DRIVING METHOD OF DISPLAY PANE, DISPLAY DEVICE, AND STORAGE MEDIUM", filed in the National Intellectual Property Administration, PRC on Jan. 30, 2019, the entirety of which is hereby incorporated by reference.

FIELD

The present application relates to the field of liquid crystal panel display, and in particular, relates to a driving device of a display panel, a driving method of a display panel, a display device, and a storage medium.

BACKGROUND

The statements herein only provide background information related to this application and do not necessarily constitute prior Art.

Most large-size liquid crystal display panels adopt negative Vertical Alignment (VA) or In Panel Switching (IPS). Compared with IPS liquid crystal technology, VA liquid crystal technology has the advantages of higher production efficiency and lower manufacturing cost. However, VA liquid crystal technology has obvious defects on optical property, such as color shift exists when large viewing angle images are presented.

When displaying an image, the brightness of a pixel should be linear with the voltage ideally, thereby the driving voltage of the pixel may accurately represent the gray scale of the pixel and be reflected by the brightness. When VA type liquid crystal technology being used, the brightness of the pixel may be in line with the ideal condition, i.e. the brightness of the pixel changes linearly with voltage, when the display image is viewed at a smaller viewing angle (e.g. front view). However, when the display image is viewed at a larger viewing angle (e.g. larger than 160 degrees angled to the display image), the brightness of the pixel rapidly saturates with the voltage and then slowly changes, due to the limitation of the working mechanism of VA type liquid crystal technology. As a result, at large viewing angle, the gray scale that should be presented by the driving voltage seriously deviates, in other words, color shift is generated.

An exemplary technique for alleviate color shift is to subdivide each subpixel into a main pixel and a sub-pixel, and then drive the main pixel with a higher driving voltage, and drive the sub-pixel with a lower driving voltage, and a subpixel is displayed by the main pixel together with the sub-pixel. When driving the main pixel and the sub-pixel, the higher driving voltage and the lower driving voltage may maintain the relationship between the brightness and corresponding gray scale at the front viewing angle. Generally, in the first half of the gray scale, the main pixel drives the display with a higher driving voltage and the sub-pixel does not display. The brightness of the whole subpixel is half of the brightness of the main pixel. In the second half of the gray scale, the main pixel drives the display with a higher driving voltage and the sub-pixel drives the display with a lower driving voltage. The brightness of the whole sub-pixel is half of the sum of the brightness of the main pixel and the sub-pixel. After this combination, the brightness curve at large viewing angle is closer to the ideal curve, so the color shift phenomenon at large viewing angle is improved.

However, the above method brings the problem that it is required to double the metal traces and driving devices for driving the sub-pixels, which results in reduction of the transparent opening area, adverse effect on the light transmittance of the panel, and higher cost.

SUMMARY

The main object of the present application is to provide a driving method and a driving device, a display device and a storage medium of a display panel, to solve the problem of color shift at a certain viewing angle of the current display panel.

In order to achieve the above object, the present application provides a driving device of a display panel, the display panel includes a display array including pixels arranged in an array, each of the pixels includes three subpixels sequentially arranged in a row direction, two of the subpixels adjacent in the row direction having different polarities, two of the subpixels adjacent in a column direction having different polarities; adjacent subpixels have different voltages and are alternately arranged with a higher voltage or a lower voltage; and the driving device includes:

a common electrode setting circuit, configured to take operational pictures of two frames of the display panel as one cycle, and set a common electrode voltage to be a first polarity common electrode driving voltage in a first frame of a current driving cycle, and set the common electrode voltage to be a second polarity common electrode driving voltage in a second frame of the current driving cycle; and a drive setting circuit, configured to drive the subpixels in each row of the display array by applying the first polarity common electrode driving voltage in the first frame of the current driving cycle, and drive the subpixels in each row of the display array by applying the second polarity common electrode driving voltage in the second frame of the current driving cycle.

In some embodiments, the common electrode setting circuit is further configured to generate a common electrode signal in the row direction of the display array to drive the subpixel scanned by the gate driving signal by using a source driving signal of the scanned subpixel and the common driving voltage.

In some embodiments, the subpixels in each row are provided with a driving voltage with a same polarity, during the driving cycle of operational picture of a same frame.

In addition, to achieve the above object, the present application provides a driving method of a display panel, the display panel includes a display array including pixels arranged in an array, each of the pixels includes three subpixels sequentially arranged in a row direction, adjacent subpixels in the row direction having different polarities, and adjacent subpixels in a column direction having different polarities; adjacent subpixels have different voltages and are alternately arranged with a higher voltage or a lower voltage; and the driving method includes the following operations:

taking operational picture of two frames of the display panel taken as one cycle, and driving the subpixels in each row of the display array by applying a first polarity common electrode driving voltage in a first frame of a current cycle when a common electrode voltage is a first polarity common electrode driving voltage; and driving the subpixels in each row of the display array by applying a second polarity common electrode driving voltage in a second frame of a current cycle when the common electrode voltage is a second polarity common electrode driving voltage.

In some embodiments, at a side of the display array defines a gate driving element to transmit a gate driving signal to each of the subpixels in the row direction of the display array; at an end of the display array defines a source driving circuit to transmit a source driving signal to each of the subpixels in the column direction of the display array.

In some embodiments, the operation of driving the subpixels in each row of the display array by applying a first polarity common electrode driving voltage includes:

transmitting a gate driving signal to each of the subpixels in the row direction of the display array to scan each of the subpixels in the row direction by the gate driving element; and driving the subpixels scanned in the first frame by applying the first polarity common electrode driving voltage by the source driving circuit, after a source driving signal is sent to the subpixels scanned in the first frame.

The operation of driving the subpixels in each row of the display array by applying a second polarity common electrode driving voltage includes:

transmitting a gate driving signal to each of the subpixels in the row direction of the display array to scan each of the subpixels in the row direction by the gate driving element; and driving the subpixels scanned in the second frame by applying the second polarity common electrode driving voltage by the source driving circuit after a source driving signal is sent to the subpixels scanned in the second frame by the source driving circuit.

In some embodiments, the operation of driving the subpixels scanned in the first frame by the source driving circuit by applying the first polarity common electrode driving voltage by the source driving circuit, after a source driving signal is sent to the subpixels scanned in the first frame includes:

acquiring a first current voltage value of the subpixels scanned in the first frame by the source driving circuit, after a source drive signal is sent to the subpixels scanned in the first frame, and performing dot inversion drive on the subpixels adjacent in a same column scanned in the first frame by applying the first polarity drive voltage and the first current voltage value.

The operation of driving the subpixels scanned in the second frame by applying the second polarity common electrode driving voltage by the source driving circuit, after a source driving signal is sent to the subpixels scanned in the second frame includes:

acquiring a second current voltage value of the subpixels scanned in the second frame by the source driving circuit, after a source drive signal is sent to the subpixels scanned in the second frame, and performing dot inversion drive on the adjacent subpixels in a same column scanned in the second frame by applying the second polarity drive voltage and the second current voltage value.

In some embodiments, the driving method also includes: periodically switching voltages of the display array by the common electrode voltage according to the driving inversion of polarity, when driving signals of two adjacent display arrays are inverted.

In some embodiments, the driving method also includes: driving two adjacent subpixels in a same column by using a preset data driving signal, which is an average value of historical driving signals of the two adjacent subpixels.

In addition, in order to achieve the above object, the present application also provides a display device, which includes a display panel and a driving device for the display panel.

The display panel includes a display array including pixels arranged in an array, each of the pixels includes three subpixels sequentially arranged in a row direction, two of the subpixels adjacent in the row direction having different polarities, two of the subpixels adjacent in a column direction having different polarities; adjacent subpixels have different voltages and are alternately arranged with a higher voltage or a lower voltage.

The driving device for the display panel includes a processor and a memory, the memory stores an executable instruction, the processor executes the executable instruction, and the executable instruction includes:

taking operational picture of two frames of the display panel as one cycle, and driving the subpixels in each row of the display array by applying a first polarity common electrode driving voltage in a first frame of a current cycle when a common electrode voltage is a first polarity common electrode driving voltage; and driving the subpixels in each row of the display array by applying a second polarity common electrode driving voltage in a second frame of a current cycle when the common electrode voltage is a second polarity common electrode driving voltage.

Compared with an exemplary design, both in a row direction and in a column direction of the display array of the display panel according to the present application, adjacent subpixels have different polarities and different voltages which are alternately arranged with a higher voltage or a lower voltage. The common electrode voltage required for operating picture of each frame is periodically changed by the driving device, with operational picture of two frames of the display panel taken as one driving cycle. With respect to different frames, different common electrode voltages are correspondingly applied to drive subpixels in the display array, reducing the occurrence rate of viewing angle color shift of display panel. Display panel operates according to such a driving cycle, thereby the viewing angle color shift of the display panel is improved.

BRIEF DESCRIPTION OF THE DRAWINGS

FIG. 2*a* is a schematic structural diagram of a display array in a first frame of a current driving cycle in some embodiments of the present application.

FIG. 2*b* is a schematic structural diagram of a display array in a second frame of a current driving cycle in some embodiments of the present application.

Figure 1:
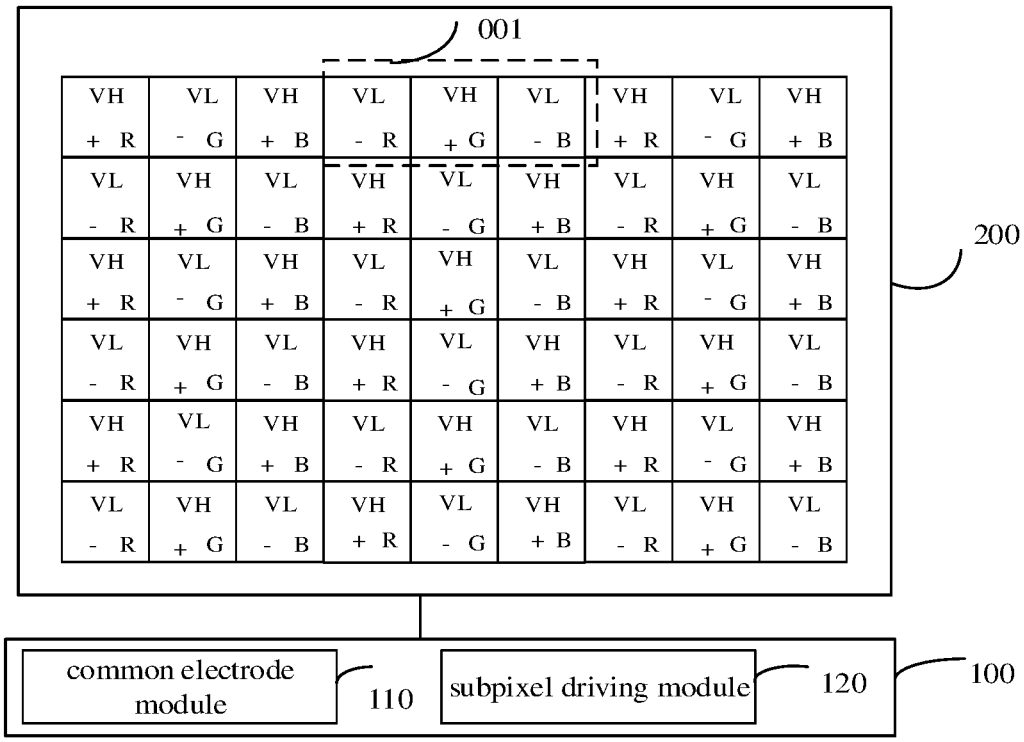
FIG. 1 is a schematic diagram of a driving device of a display panel in some embodiments of the present application.

The realization, functional characteristics and advantages of the purpose of the present application will be further explained with reference to the attached drawings in combination with embodiments.

DETAILED DESCRIPTION OF THE EMBODIMENTS

It should be understood that the specific embodiments described herein are only for the purpose of explaining the present disclosure and are not intended to limit the present disclosure.

The following is a clear and complete description of the technical solutions in the embodiments of the present application with reference to the drawings in the embodiment of the present application. Obviously, the described embodiment is only a part of the embodiment of this application, not all of the embodiments. All other embodiments obtained by those of ordinary skill in the art without creative work are within the scope of protection of this application. Changes in the illustrated shape may be expected as a result of manufacturing techniques and/or tolerances. Therefore, the embodiments of the present application should not be interpreted as being limited to the specific shape of the region shown here, but including deviations in shape due to factors such as manufacturing. Therefore, the regions shown in the figures are schematic in nature, and their shapes are not intended to show the precise shape of the regions, and are not intended to limit the scope of the embodiments.

In the description of this application, it is to be understood that the orientation or positional relationship indicated by the terms "vertical", "lateral", "upper", "lower", "left", "right", "horizontal", "both sides", "bottom", "middle", "inner", etc. is based on the orientation or positional relationship shown in the drawings, only for convenience of description of this application and simplification of description, and does not indicate or imply that the indicated device or element must have a specific orientation, be constructed and operated in a specific orientation, and therefore cannot be understood as a limitation of this application.

Furthermore, the terms "first" and "second" are used for descriptive purposes only and cannot be understood as indicating or implying relative importance or implicitly indicating the number of technical features indicated. In the description of this application, unless otherwise stated, "multiple" and "multi-" mean two (two) or more than two (two).

In addition, the term "including" and any variations thereof are intended to cover a non-exclusive comprising.

Referring to FIG. 1, FIG. 1 is a schematic diagram of a driving device of a display panel in some embodiments of the present application.

In the embodiments, the display panel 200 includes a display array including pixels 001 arranged in an array, each of the pixels includes three subpixels sequentially arranged in a row, adjacent subpixels in the display array in the row direction have different polarities, adjacent subpixels in the display array in a column direction have different polarities; adjacent subpixels have different voltages and are alternately arranged with a higher voltage or a lower voltage; and Specifically, as shown in FIG. 1, one pixel includes subpixel R (red), subpixels G, and subpixels B, which are sequentially arranged in the row direction. The polarities of adjacent subpixels both in the row direction and in the column direction of the display array are different, and the voltages of adjacent subpixels in the display array are different. That is, the voltage of subpixels may be divided into a lower voltage (e.g. subpixel marked with L in FIG. 1) and a higher voltage (e.g. subpixel marked with H in FIG. 1).

It may be understood that the display gray scale of a high-voltage unit subpixel is brighter, while the display gray scale of a low-voltage unit subpixel is darker. As shown in FIG. 1, adjacent subpixels R, G, and B are alternately arranged with a higher or a lower voltage.

In the embodiments, the polarity of the high-voltage unit subpixel in the first frame of the current driving cycle is positive, that is to cooperate with the display panel to drive the high-voltage subpixels by using positive polarity. However, the polarity of the low-voltage unit subpixel is negative, that is, to cooperate with the display panel to drive the low-voltage subpixels by using negative polarity.

Similarly, when the driving cycle is switched to the second frame, the polarity of the high-voltage unit subpixel in the second frame is negative, that is to cooperate with the display panel to drive the high-voltage subpixels by using negative polarity. However, the polarity of the low-voltage unit subpixel is positive, that is, to cooperate with the display panel to drive the low-voltage subpixels by using positive polarity.

Accordingly, the driving device 100 includes:

a common electrode setting circuit 10, configured to set a common electrode voltage as a first polarity common electrode driving voltage in a first frame of a current driving cycle, the first polarity common electrode driving voltage is smaller than a reference voltage; and in the second frame of the current driving cycle, the common electric voltage is set as a second polarity common electrode driving voltage, and the second polarity common electrode driving voltage is larger than a reference voltage; and a drive setting circuit 20, configured to drive the subpixels in each row of the display array by applying the first polarity common electrode driving voltage in the first frame of the current cycle, and configured to drive the subpixels in each row of the display array by applying the second polarity common electrode driving voltage in the second frame of the current cycle.

It should be noted that the common electrode driving voltage in this embodiment works in positive and negative polarity drive modes with respect to the original common electrode voltage of the display panel. The original common electrode voltage of the display panel is referred to as Vcom, and the common electrode voltage set by the common electrode setting circuit 10 is referred to as Vcom1, for describing conveniently.

Referring to FIG. 2*a*, FIG. 2*a* is a schematic structural diagram of a display array in a first frame of a current driving cycle in this embodiment. In the first frame, the common electrode setting circuit 10 sets the common electrode voltage Vcom1 as a first polarity common electrode driving voltage, the common electrode voltage Vcom1 is smaller than the original common electrode voltage Vcom, that is Vcom1<Vcom, and the first polarity common electrode driving voltage is a negative polarity driving voltage.

Referring to FIG. 2*b*, FIG. 2*b* is a schematic structural diagram of a display array in a second frame of a current driving cycle. The common electrode setting circuit 10 sets the common electrode voltage Vcom1 as a second polarity common electrode driving voltage, the common electrode voltage Vcom1 is larger than the original common electrode voltage Vcom, that is Vcom1>Vcom, and the second polarity common electrode driving voltage is a positive polarity driving voltage.

It may be understood that, in FIGS. 2*a* and 2*b*, VGd_1 is represented as the voltage of the display gray scale of the subpixels at the first row in the G column, VGd_2 is represented as the voltage of the display gray scale of the subpixels at the second row in the G column, VGd_3 is represented as the voltage of the display gray scale of the subpixels at the three row in the G column, VGd_4 is represented as the voltage of the display gray scale of the subpixels at the four row in the G column, VGd_5 is represented as the voltage of the display gray scale of the subpixels at the five row in the G column, VGd_6 is represented as the voltage of the display gray scale of the subpixels at the six row in the G column.

Specifically, in the first frame of the current driving cycle, the common electrode setting circuit 10 sets the Vcom voltage (i.e., common electrode voltage) as a negative common electrode driving voltage; and to set the common electrode voltage as a second polarity common electrode driving voltage in a second frame of the current driving cycle.

Cooperated with common electrode voltage of negative polarity to drive (common electrode voltage of negative polarity is that common electrode voltage Vcom1 is smaller than the original common electrode voltage Vcom, namely Vcom1<Vcom). After the first frame is switched to the second frame, the high-voltage unit subpixel is negative drive, the low-voltage unit subpixel is positive drive. Cooperating with common electrode voltage of positive polarity to drive (common electrode voltage of positive polarity is that common electrode voltage Vcom1 is larger than the original common electrode voltage Vcom, namely Vcom1>Vcom).

Figure 3:
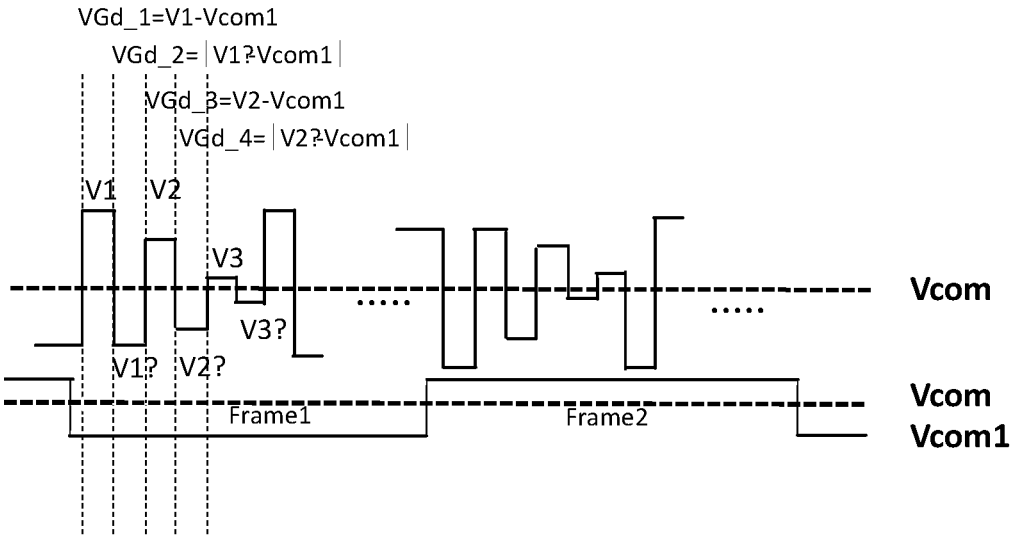
FIG. 3 is a schematic diagram of driving sequence of a display array in some embodiments of the present application.

It may be understood that referring to FIG. 2*a* (FIG. 2*b*) in combination with FIG. 3, the following timing of the display array in FIG. 3, referring to the driving mode of the display array in FIG. 2*a* (FIG. 2B), the common electrode voltages Vcom1 corresponding to the high-voltage subpixels VGd_1, VGd_3, VGd_5 and the low-voltage subpixels VGd_2, VGd_4, VGd_6 in the G-column subpixels (subpixels in R-column are the same with B-column) in the display array 1 (Frame 1) in FIG. 3 are negative driving voltages (the common electrode voltage Vcom1 with negative polarity is smaller than the original common electrode voltage Vcom, i.e., Vcom1<Vcom). High-voltage subpixels VGd_1, VGd_3, VGd_5 are positive driving voltages (>Vcom), and low voltage sub-pixels VGd_2, VGd_4, VGd_6 are negative driving voltages (<Vcom).

With the inversion of the driving signals of two adjacent display arrays, the common electrode voltage is also used to switch the periodic voltages of the display arrays in cooperation with the inversion of the driving polarity (referring to the timing switch of the display arrays shown in FIG. 3, Frame 1/Frame2), i.e., the common electrode voltage Vcom1 is a positive driving voltage (the common electrode voltage with positive polarity Vcom1 is larger than the original common electrode voltage Vcom, i.e., Vcom1>Vcom). In addition, high-voltage subpixels VGd_1, VGd_3, VGd_5 are driving voltages with negative polarity (<Vcom), and low-voltage subpixels VGd_2, VGd_4, VGd_6 are driving voltages with positive polarity (>Vcom).

With continued reference to the timing diagram of the display array of FIG. 3, the subpixel positive driving signals Vgd of column G=V1, V2, V3, . . . , and the subpixel negative driving signals Vgd=V1', V2', V3' . . . , where (V1, V2, V3 . . . >Vcom, V1', V2', V3' . . . <Vcom). When in the timing sequence of Frame1, the equivalent driving voltage VGd_1 of the high-voltage subpixel is the difference between the positive driving voltage Vgd=V1(V1>Vcom) and the negative common electrode voltage Vcom1 (Vcom1<Vcom), that is, VGd_1=|V1−Vcom1. The next adjacent low-voltage subpixel VGd_2 is the difference between the negative driving voltage Vgd=V1'(V1'<Vcom) and the negative common electrode voltage Vcom1 (Vcom1<Vcom), that is, VGd_2=|V1'−Vcom1|, so VGd_1>VGd_2. Similarly, the high-voltage sub-pixel VGd_3 and the low-voltage sub-pixel VGd_4 are driven in sequence. The equivalent driving voltage VGd_3 of the high-voltage subpixel is the difference between the positive driving voltage Vgd=V2 (V2>Vcom) and the negative common voltage Vcom1(Vcom1<Vcom), i.e. VGd_3=|V2−Vcom1|. The next adjacent low voltage sub-pixel VGd_4 is the difference between the negative driving voltage Vgd=V2' (V2'<Vcom) and the negative common voltage Vcom1, i.e. VGd_4=|V2'−Vcom1|, so VGd_3>VGd_4.

Two adjacent subpixels in a same column are driven by using a preset data driving signal, which is an average value of historical driving signals of two adjacent subpixels.

The equivalent voltages of VGd_1 and VGd_2 are respectively driven by the positive driving voltage Vgd=V1 and the negative driving voltage Vgd=V1', and the positive driving voltage V1 and the negative driving voltage V1' may be the average signal of the pixel signal Gd1 and Gd2 signal of the original display array (0-255 signals in terms of 8-bit driving signals), namely G1=(Gd1+Gd2)/2, and G1 signals correspond to the positive driving voltage V1 and the negative driving voltage V1'. The equivalent voltages of VGd_3 and VGd_4 are respectively driven by the positive driving voltage Vgd=V2 and the negative driving voltage Vgd=V2', and may be selected as the average signals of the original display array pixel signals Gd3 and Gd4 (0-255 signals in terms of 8-bit driving signals), namely G2=(Gd3+Gd4)/2, and the positive driving voltage V2 and the negative driving voltage V2' correspond to the G2 signals.

Compared with an exemplary design, both in a row direction and in a column direction of the display array of the display panel according to the embodiments, adjacent subpixels have different polarities. adjacent subpixels have different voltages and are alternately arranged with a higher voltage or a lower voltage. the common electrode voltage required for operating picture of each frame is periodically changed by the driving device, with operational picture of two frames of the display panel taken as one driving cycle. With respect to different frames, different common electrode voltages are correspondingly applied to drive subpixels in the display array, reducing the occurrence rate of viewing angle color shift of display panel. Display panel operates according to such driving cycle, thereby the viewing angle color shift of the display panel is improved.

Configuring to send a source driving signal to the subpixels scanned by the gate driving element, so that the drive setting circuit sets the first polarity common electrode driving voltage or the second polarity common electrode driving voltage to drive the scanned subpixels.

The common electrode setting circuit 10 is further configured to generate a common electrode signal in the row direction of the display array so that sub-pixels scanned by the gate drive signal acquire a common electrode drive voltage, and every common electrode signal provides a common electrode driving voltage for each row of subpixels.

Figure 4:
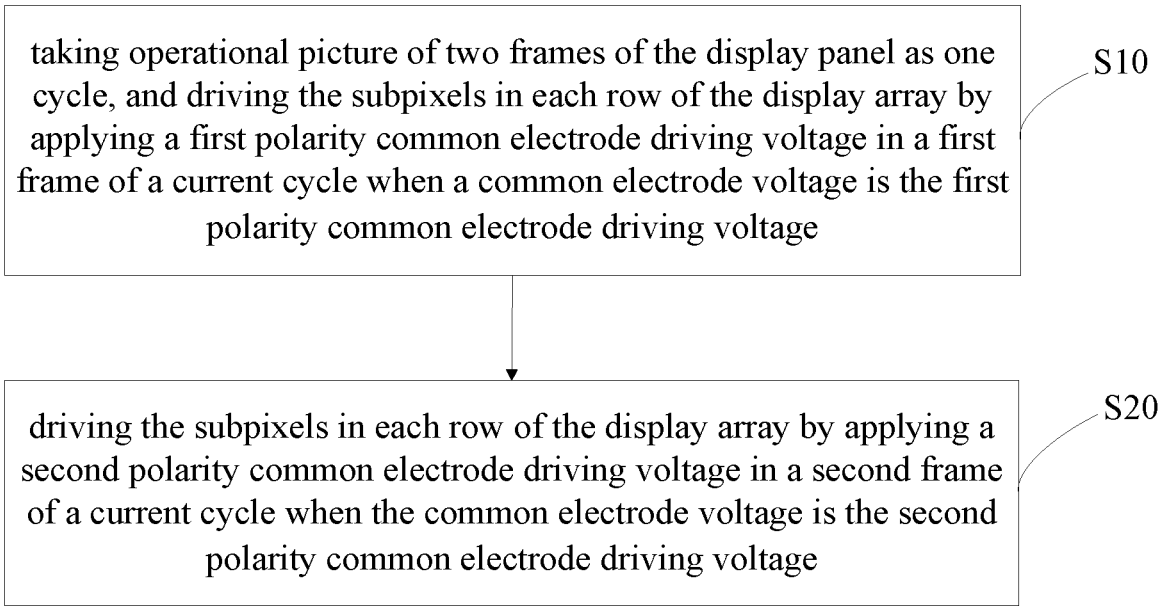
FIG. 4 is a flow chart of a driving method of a display panel in some embodiments of the present application.

In addition, referring to FIG. 4, the present application also provides a driving method of the display panel. FIG. 4 is a flow chart of a driving method of a display panel in some embodiments of the present application.

In the embodiments, the display panel includes a display array including pixels arranged in an array, each of the pixels includes three subpixels sequentially arranged in a row direction, two subpixels adjacent in the display array in the row direction have different polarities, two subpixels adjacent in the display array in a column direction have different polarities; adjacent subpixels have different voltages and are alternately arranged with a higher voltage or a lower voltage.

Accordingly, the driving method includes:

S10 taking operational picture of two frames of the display panel as one cycle, and driving the subpixels in each row of the display array by applying a first polarity common electrode driving voltage in a first frame of a current cycle when a common electrode voltage is the first polarity common electrode driving voltage.

It should be noted that at a side of the display array defines a gate driving element, and at an end of the display array defines a source driving circuit.

It may be understood that the subpixels in each row of the display array is driven by applying a first polarity common electrode driving voltage in a first frame of a current cycle when a common electrode voltage is the first polarity common electrode driving voltage, with operational picture of two frames of the display panel taken as one cycle That is, a gate driving signal to each of the subpixels in the row direction of the display array is transmitted to scan each of the subpixels in the row direction by the gate driving element; and a source driving signal is sent to the subpixels scanned in the first frame by the source driving circuit, so as to drive the subpixels scanned in the first frame by applying the first polarity common electrode driving voltage.

In a specific example, the drive setting circuit acquires a first current voltage value of subpixels scanned in the first frame, and dot inversion drive is performed on the adjacent subpixels in a same column scanned in the first frame, by applying the first polarity drive voltage and the first current voltage value. In the embodiments, the first polarity common electrode driving voltage in the first frame may be a positive polarity common electrode driving voltage, and correspondingly, the first current voltage value is a positive polarity voltage value.

S20 driving the subpixels in each row of the display array by applying a second polarity common electrode driving voltage in a second frame of a current cycle when the common electrode voltage is the second polarity common electrode driving voltage.

It may be understood that the subpixels in each row of the display array is driven by applying a second polarity common electrode driving voltage in a second frame of a current cycle when the common electrode voltage is set as the second polarity common electrode driving voltage by the drive setting circuit. That is, a gate driving signal to each of the subpixels in the row direction of the display array is transmitted to scan each of the subpixels in the row direction by the gate driving element; and a source driving signal is sent to the subpixels scanned in the second frame by the source driving circuit, so as to drive the subpixels scanned in the second frame by applying the second polarity common electrode driving voltage.

Specifically, when the drive setting circuit acquires the second current voltage value of the subpixels scanned in the second frame, dot inversion drive may be performed on the adjacent subpixels in a same column scanned in the second frame, by applying the second polarity drive voltage and the second current voltage value. In the embodiments, the second polarity common electrode driving voltage in the second frame may be a positive polarity common electrode driving voltage, and correspondingly, the second current voltage value is a positive polarity voltage value.

Compared with an exemplary design, both in a row direction and in a column direction of the display array of the display panel according to the embodiments, adjacent subpixels have different polarities. adjacent subpixels have different voltages and are alternately arranged with a higher voltage or a lower voltage. The common electrode voltage required for operating picture of each frame is periodically changed by the driving device, with operational picture of two frames of the display panel taken as one driving cycle. With respect to different frames, different common electrode voltages are correspondingly applied to drive subpixels in the display array, reducing the occurrence rate of viewing angle color shift of display panel. Display panel operates according to such a driving cycle, thereby the viewing angle color shift of the display panel is improved.

In addition, the present application also provides a display device, which includes a display panel and a driving device as described above.

The display panel includes a display array including pixels arranged in an array, each of the pixels includes three subpixels sequentially arranged in a row, adjacent subpixels in the display array in directions of a row and a column have different polarities; adjacent subpixels have different voltages and are alternately arranged with a higher voltage or a lower voltage.

The driving device defines a processor, a memory and a driver program of a display panel stored in the memory and executable in the processor, the driver program of the display panel is configured to implement the operations of the driving method of the display panel as described above.

The above description is only an alternative embodiment of the present application, and is not intended to limit the patent scope of the present application. Any equivalent structural changes made by using the description and drawings of the present application or direct/indirect application in other related technical fields are included in the patent protection scope of the present application under the concept of the present application.

What is claimed is:

1. A driving method of a display panel, wherein the display panel comprises a display array comprising pixels arranged in an array, each of the pixels comprises three subpixels sequentially arranged in a row direction, two of the subpixels adjacent in the row direction having different polarities; two of the subpixels adjacent in a column direction having different polarities; two of the subpixels adjacent in the display array have different voltages and are alternately arranged with a higher voltage or a lower voltage; and the driving method comprises operations of:

taking two frames of the display panel as one cycle, and driving the subpixels in each row of the display array by applying a first polarity common electrode driving voltage in a first frame of a current cycle when a common electrode voltage is a first polarity common electrode driving voltage; and driving the subpixels in each row of the display array by applying a second polarity common electrode driving voltage in a second frame of a current cycle when the common electrode voltage is a second polarity common electrode driving voltage;

wherein at a side of the display array defines a gate driving element to transmit a gate driving signal to each of the subpixels in the row direction of the display array; at an end of the display array defines a source driving circuit to transmit a source driving signal to each of the subpixels in the column direction of the display array;

the operation of driving the subpixels in each row of the display array by applying a first polarity common electrode driving voltage, comprises:

transmitting a gate driving signal to each of the subpixels in the row direction of the display array to scan each of the subpixels in the row direction by the gate driving element; and driving the subpixels scanned in the first frame by applying the first polarity common electrode driving voltage by the source driving circuit, after the source driving signal is sent to the subpixels scanned in the first frame;

the operation of driving the subpixels in each row of the display array by applying a second polarity common electrode driving voltage, comprises:

transmitting a gate driving signal to each of the subpixels in the row direction of the display array to scan each of the subpixels in the row direction by the gate driving element; and driving the subpixels scanned in the second frame by applying the second polarity common electrode driving voltage by the source driving circuit, after the source driving signal is sent to the subpixels scanned in the second frame;

the operation of driving the subpixels scanned in the first frame by applying the first polarity common electrode driving voltage by the source driving circuit, after the source driving signal is sent to the subpixels scanned in the first frame comprises:

acquiring a first current voltage value of the subpixels scanned in the first frame by the source driving circuit after the source drive signal is sent to the subpixels scanned in the first frame, and performing dot inversion drive on two adjacent of the subpixels in a same column scanned in the first frame by applying the first common polarity drive voltage and the first current voltage value;

the operation of driving the subpixels scanned in the second frame by applying the second polarity common electrode driving voltage by the source driving circuit, after the source driving signal is sent to the subpixels scanned in the second frame comprises:

acquiring a second current voltage value of the subpixels scanned in the second frame, after the source driving circuit sending a source drive signal to the subpixels scanned in the second frame, and performing dot inversion drive on two of the subpixels next to each other in a same column scanned in the second frame by applying the second polarity drive voltage and the second current voltage value;

the driving method further comprises:

periodically switching voltages of the display array according to the driving inversion of polarity by the common electrode voltage, when driving signals of two adjacent display arrays are inverted; and driving two adjacent of the subpixels in a same column by using a preset data driving signal, which is an average value of historical driving signals of the two adjacent of the subpixels.

2. A display device, comprising:

a display panel comprising a display array; and a driving device for the display panel, wherein the display array comprises pixels arranged in an array, each of the pixels comprising three subpixels sequentially arranged in a row direction, two of the subpixels adjacent in the row direction having different polarities, and two of the subpixels adjacent in a column direction having different polarities; two of the subpixels adjacent in the display array have different voltages and are alternately arranged with a higher voltage or a lower voltage;

the driving device for the display panel comprises a processor and a memory, the memory stores an executable instruction, the processor executes the executable instruction to implement:

taking two frames of the display panel as one cycle and driving the subpixels in each row of the display array by applying a first polarity common electrode driving voltage in a first frame of a current cycle when a common electrode voltage is a first polarity common electrode driving voltage; and driving the subpixels in each row of the display array by applying a second polarity common electrode driving voltage in a second frame of a current cycle when the common electrode voltage is a second polarity common electrode driving voltage;

at a side of the display array defines a gate driving element to transmit a gate driving signal to each of the subpixels in the row direction of the display array; at an end of the display array defines a source driving circuit to transmit a source driving signal to each of the subpixels in the column direction of the display array;

the processor executes the executable instruction to implement:

transmitting a gate driving signal to each of the subpixels in the row direction of the display array to scan each of the subpixels in the row direction by the gate driving element;

driving the subpixels scanned in the first frame by applying the first polarity common electrode driving voltage by the source driving circuit, after a source driving signal is sent to the subpixels scanned in the first frame;

driving the subpixels scanned in the second frame by applying the second polarity common electrode driving voltage by the source driving circuit, after a source driving signal is sent to the subpixels scanned in the second frame;

acquiring a first current voltage value of the subpixels scanned in the first frame by the source driving circuit after a source drive signal is sent to the subpixels scanned in the first frame, and performing dot inversion drive on two of the subpixels adjacent in a same column scanned in the first frame by applying the first polarity drive voltage and the first current voltage value;

acquiring a second current voltage value of the subpixels scanned in the second frame by the source driving circuit after a source drive signal is sent to the subpixels scanned in the second frame, and performing dot inversion drive on two of the subpixels adjacent in a same column scanned in the second frame by applying the second polarity drive voltage and the second current voltage value;

periodically switching the voltages of the display array by applying the driving inversion of polarity by the common electrode voltage, when the driving signals of two adjacent display arrays are inverted; and driving two adjacent of the subpixels in a same column by using a preset data driving signal, which is an average value of historical driving signals of the two adjacent of the subpixels.

* * * * *